United States Patent [19]

Almblad et al.

[11] Patent Number: 4,651,604

[45] Date of Patent: Mar. 24, 1987

[54] APPARATUS FOR AND METHOD OF DUPLICATIVE PUNCHED NOTCHING OF THE SERRATION EDGES OF KEY BLANKS

[75] Inventors: Donald F. Almblad, 5718 Capri La., Morton Grove, Ill. 60053; Michael A. Mueller; Thomas L. Drehobl, both of Lyndenhurst, Ill.

[73] Assignee: Donald F. Almblad, Scottsdale, Ariz.

[21] Appl. No.: 776,477

[22] Filed: Sep. 16, 1985

[51] Int. Cl.[4] ..... B26F 1/12

[52] U.S. Cl. ..... 83/50; 83/412; 83/415; 83/588; 83/618; 83/917

[58] Field of Search ..... 83/917, 50, 412, 414, 83/415, 693, 588, 618

[56] References Cited

U.S. PATENT DOCUMENTS 894,726 7/1908 Corbin ..... 83/917 X
2,812,816 11/1957 Hoffman ..... 83/917 X
3,981,214 9/1976 Wich ..... 83/917 X
4,019,415 4/1977 Wich ..... 83/917 X

*Primary Examiner*—Horace M. Culver
*Attorney, Agent, or Firm*—Hill, Van Santen, Steadman & Simpson

[57] ABSTRACT

Apparatus and method for duplicative notching of the serration edge on a key blank according to the serration edge of an existing key serving as a templet. An axially movable key edge notching punch is controlled by the templet for punching a notch in the serration edge of the key blank corresponding to a notch in the serration edge of the templet when the punch is driven toward the key blank. The key blank and the templet key may be supported in a cassette which is indexible relative to the punch. The cassette and the notching mechanism are especially advantageous for notching the serration edges of key blanks carried by wallet size plastic cards.

20 Claims, 10 Drawing Figures

APPARATUS FOR AND METHOD OF DUPLICATIVE PUNCHED NOTCHING OF THE SERRATION EDGES OF KEY BLANKS

BACKGROUND OF THE INVENTION

1. Field Of The Invention

This invention relates in general to the duplication of the serration edges of keys such as vehicle ignition and trunk keys, house keys, and other similar lock keys, having notched, serration edges along their shanks.

2. Prior Art

It has heretofore been common practice to duplicate keys of the type indicated by grinding notches in the serration edges of the key shanks, using the serration edge of an existing key as a templet. House keys are commonly duplicated in this manner.

Duplication of automotive vehicle keys has generally been by means of an apparatus operating according to numeric code. Machines for this purpose are equipped with coding devices by which when the machine is instructed through keys or levers, the serration edge of a blank held in the machine is cut or notched out in accordance with the particular coded instruction. With originally issued vehicle keys, there is usually supplied in a confidential manner the code numerals for each particular key. Should a duplicate key be required, the particular code numerals for the key must be available for obtaining a duplicate. If the originally supplied code information is lost and not readily available from the original source, considerable inconvenience may be entailed in securing the information and may require aggravating delay.

In order to avoid the bother of obtaining duplicates when keys have been mislaid or lost or have become otherwise unavailable, many persons perfer to secure duplicate keys maintained conveniently available in some hideaway.

For convenient wallet or purse carrying of duplicate keys a novel concept of key and retainer card is disclosed in the copending application of Donald F. Almblad, Ser. No. 619,936 filed June 12, 1984. According to that disclosure, keys, or at least the blanks therefor, are carried in lightweight generally credit card size cards which may be formed from durable plastic. In a perferred form, the cards and keys are fabricated as by casting or injection molding in an integral unit wherein the keys are connected in a breakaway and/or hinged fashion to the retainer card. Such card carried keys are difficult, if not impossible to provide with their serration edges cut or otherwise fashioned in the heretofore available key duplicating apparatus.

SUMMARY OF THE PRESENT INVENTION

An important object of the present invention is to provide a new and improved apparatus for and method of duplicating the serration edges of keys.

Another object of the invention is to provide a new and improved apparatus and method of key duplication, wherein a serrating punch is controlled by a key which is to be duplicated.

A further object of the invention, is to provide new and improved duplicate key means.

In accordance with the principles of the present invention, there is provided apparatus for duplicative notching of the serration edge on a key blank according to the serration edge of an existing key serving as a templet, and comprising an axially movable key edge notching punch; means for movably supporting the punch; means for supporting the key blank and the templet in such relation to the punch that, under the control of the templet, the punch will upon axial movement in one direction form a notch in the serration edge of the key blank corresponding to a notch in the serration edge of the templet; and means for effecting axial notching movement of the punch.

In the new and improved apparatus of the present invention, there is provided a novel arrangement of key supporting cassette and floating serration edge forming punch.

A method for duplicating keys is also provided and which may be practiced by use of the described apparatus.

Improvements in the key card structure of the Almblad application are also disclosed herein.

BRIEF DESCRIPTION OF THE DRAWINGS

Other objects, features and advantages of the present invention will be readily apparent from the following description of representative embodiments thereof, taken in conjunction with the accompanying drawings, although variations and modifications may be effected without departing from the spirit and scope of the novel concepts embodied in the disclosure and in which.

DETAILED DESCRIPTION

Figure 1:
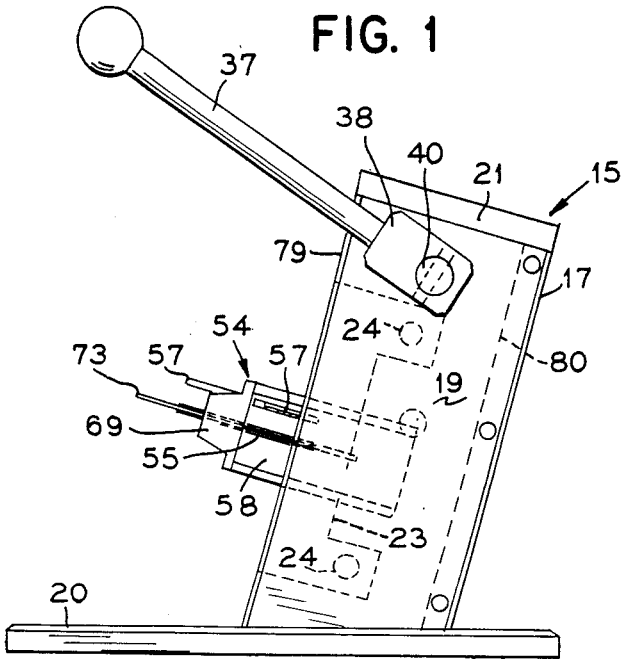
FIG. 1 is a side elevational view of a key duplicator according to the present invention.

A key duplicating machine, i.e. duplicator, 15 (FIGS. 1, 2, 3 and 4) embodying the present invention comprises a frame 17 having spaced parallel upstanding side wall panels 18 and 19 mounted on a horizontal base such as a plate 20, and provides a convenient portable device. A top panel 21 is secured to the upper edges of the side frame panels 18 and 19. For convenient access, the duplicator 15 is disposed in a rearwardly tilted orientation on the base, and which presents the front of the unit in a generally forwardly upwardly facing relation.

Supported within the frame 17 by and between the side panels 18 and 19 is an axially movable key edge notching punch 22 carried by a carriage 23 comprising a vertically elongated body block horizontally floatingly mounted on vertically spaced parallel guide track means comprising rods 24 having their ends fixedly mounted in respective sockets 25 in the side plates 18 and 19. As shown, the body of the carriage 23 has adjacent to its upper and lower ends horizontally extending parallel bores 27 (FIG. 3) therethrough within which are press fitted bushing bearings 28 through which the track rods 24 extend in slidable relation. It will be observed that the carriage 23 is only fractionally as wide as the space between the side plates 18 and 19.

Figure 4:
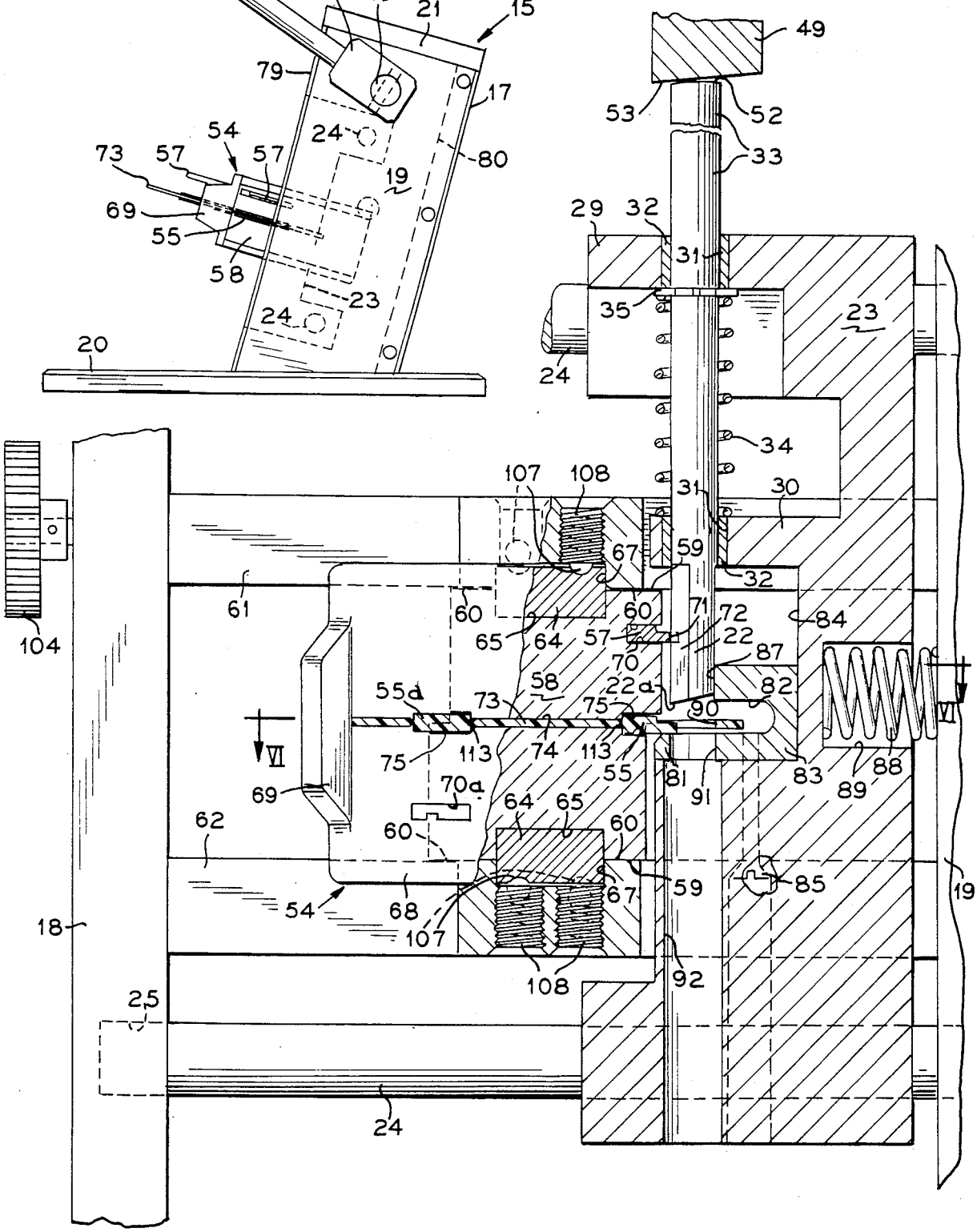
FIG. 4 is an enlarged fragmentary sectional detailed view taken substantially along the line IV—IV in FIG. 3.

Support for the punch 22 is provided on the carriage 23 by and between vertically spaced forward guide bearing flanges comprising an upper flange 29 and a lower flange 30 which, as best seen in FIG. 4, have respective axially aligned bearing bores 31 within which are mounted bushing bearings 32 for slidably guiding an elongated upwardly extending rod-like shank 33 having the punch 22 integrally on its lower end. Normally, the punch is biased upwardly to a predetermined extent by means of a coil spring 34 which thrusts at its lower end against the upper face of the lower flange 30, and thrusts at its upper end against a shoulder 35 comprising a snap ring carried by the shank 33 and serving also as a stop against the underside of the upper flange 29.

Means for driving the punch plunger 22, 33 downwardly in opposition to the biasing means spring 34 in a punching stroke may comprise a powered device such as a solenoid but is shown conveniently in the form of a manually operable handle 37 having a hub 38 keyed as by means of a pin 39 to a shaft 40 projecting from one side of the device, herein the right side frame panel 19. The shaft 40 is of a length to extend through a bushing bearing 41 in the upper portion of the frame panel 19 and extends at its opposite end into a coaxial bushing bearing 42 carried by the frame panel 18. Axial displacement of the shaft 40 is avoided by shoulder means in the form of respective snap rings 43 carried by the shaft adjacent to the inside faces of the frame panels 18 and 19. Normally, the shaft 40 is biased in a counterclockwise direction as viewed in FIG. 3 by means of a coiled torsion spring 44 which has one end 45 anchored to the frame plate 19 and the other end in the form of a hook 47 anchored to a bar 48 projecting parallel to the spring 44 from a punch-actuating block 49 keyed to the shaft 40 as by means of a pin 50. The arrangement is such that the block 49 by virtue of the bias applied to the shaft 40 by the spring 44 is caused to shoulder against a stop surface 51 carried by the underside of the top plate 21. Location of the actuator block 49 on the shaft 40 is in overlying relation to a smoothly contoured upper terminal 52 on the punch shaft or rod plunger 33, which as upwardly biased, maintains the terminal 52 in association with a cam surface 53 on the actuator block 49. As will be apparent in FIG. 3, upon depressing the handle 37 against the bias of the spring 44, the punch plunger 33 will be correspondingly depressed in opposition to the bias of the spring 34 in a punching stroke.

Means comprising a cassette 54 (FIGS. 1, 3, 4 and 5) are provided for supporting a key blank 55 and an existing key 57 in such relation to the punch 22, that under the control of the existing key 57 serving as a templet, the punch will upon axial movement in one direction, that is in the downward direction, form a notch in the serration edge of the key blank corresponding to a notch in the serration edge of the templet. In a simple and efficient construction, the cassette 54 comprises a body 58 which may conveniently be in the form of a one-piece molding or casting which is desirably elongated in a front to rear direction (FIG. 5) and is dimensioned from top to bottom to provide upper and lower surfaces 59 which are slidably engagable with front to rear bearing surfaces 60 provided by an upper horizontal guide plate or panel 61 and a lower spaced parallel guide plate or panel 62. Both of the panels 61 and 62 may be secured fixedly to the side walls 18 and 19 in any suitable manner such as by means of pins 63.

For guiding the cassette 54 in a front to rear direction, respective medially positioned upper and lower tracking bars 64 carried in parallel upper and lower grooves 65 in the body 58 project respectively upwardly and downwardly from the surfaces 59 and are received in respective complementary trackway grooves 67 in the plate members 61 and 62 extending in a front to rear direction so that the cassette 54 can be inserted endwise into the duplicator 15 and removed in reverse as desired. On its front end, the cassette body 58 is desirably provided with a symmetrical lateral flange structure 68 carrying forwardly extending relatively divergent manipulating handle wing means 69.

For supporting the existing key 57 to serve as a templet, the cassette body 58 has along at least one side, and adjacent to what will be the top of the cassette when installed in the apparatus, a laterally and forwardly opening templet key socket 70 which receives the key 57 with its serration edge 71 exposed along the side of the cassette body in a manner to engage with a vertical notch depth control edge 72 of the punch 22.

Figure 6:
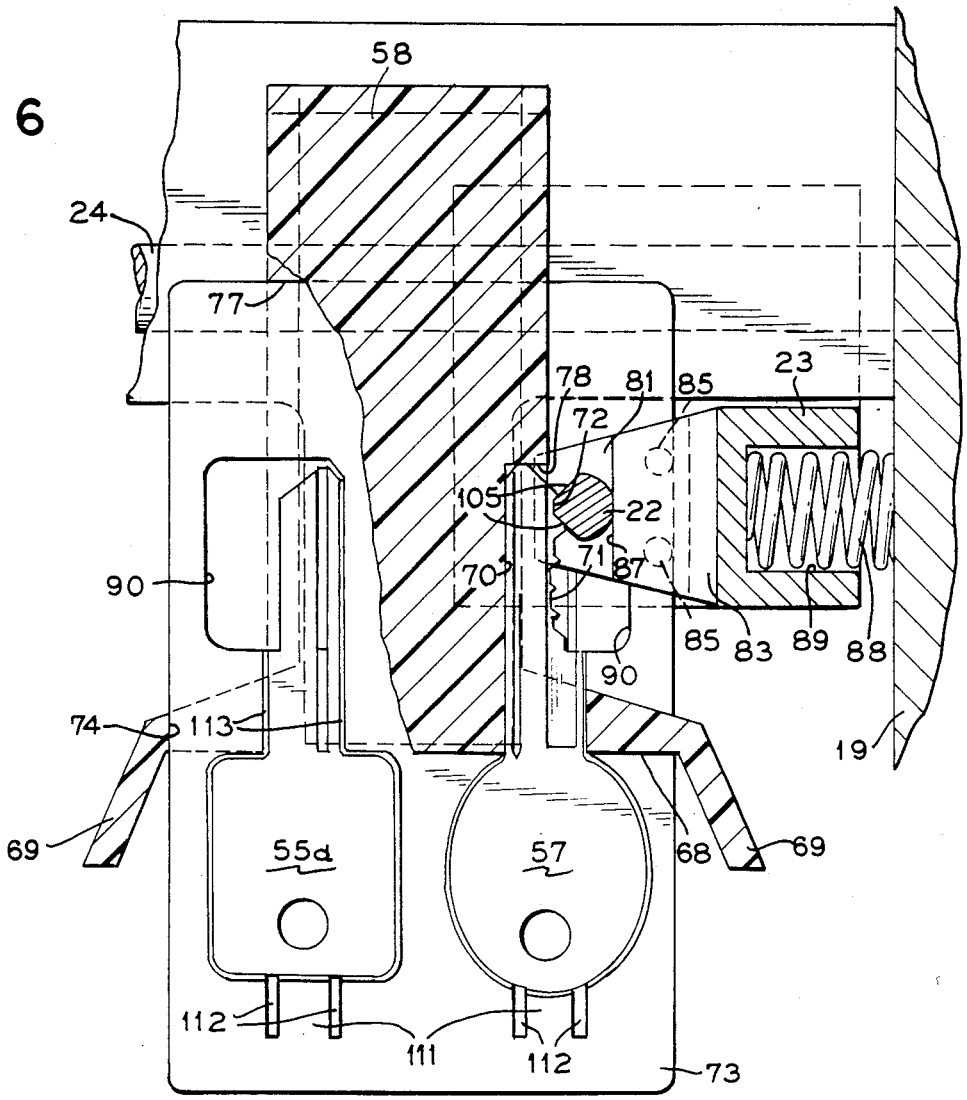
FIG. 6 is a sectional plan view taken substantially along the line VI—VI in FIG. 4.

Where, as shown, the key blank 55 is to be one of a pair of keys to be carried by a carrying card 73 pursuant to the teachings in the before-mentioned copending application Ser. No. 619,936, the cassette body 58 has a horizontal slot socket 74 to receive the card. As seen in FIG. 4, since the card 73 is desirably thinner than the key blank 55 carried thereby, a suitably greater vertically dimensioned laterally opening slot 75 is provided to accommodate the key blank 55 in punching orientation along the side of the cassette body. Where, for example, a pair of complementary keys is to be carried by the card 73, such as the ignition key and the door lock key for an automobile, the cassette body 58 is provided with an equal and opposite socket 75 for the companion key 55*a*. It will also be observed that because of the overall width of the card 73 wherein supporting portions of the card project laterally alongside the keys 55 and 55*a*, the slot in the front side flange portion 68 is of a total width between the side handle wings 69 to receive and guide the card 73 into the cassette, the inner end of the socket slot 74 serving as a stop shoulder 77 to limit the inward extension of the card 73 to provide the proper punching alignment with the templet key 57, which, as best seen in FIG. 6, is oriented to the desired depth within the body 58 by stop shoulder 78 at the inner end of the socket 70.

Loading of the cassette 54 with the templet key 57 and the key card 73 is adapted to be effected either before or after the cassette 54 has been introduced into the duplicator unit 15, by inserting the templet key 57 and the blank key carrying card 73 through the front end openings into the respective sockets.

Figures 3, 8, 9:
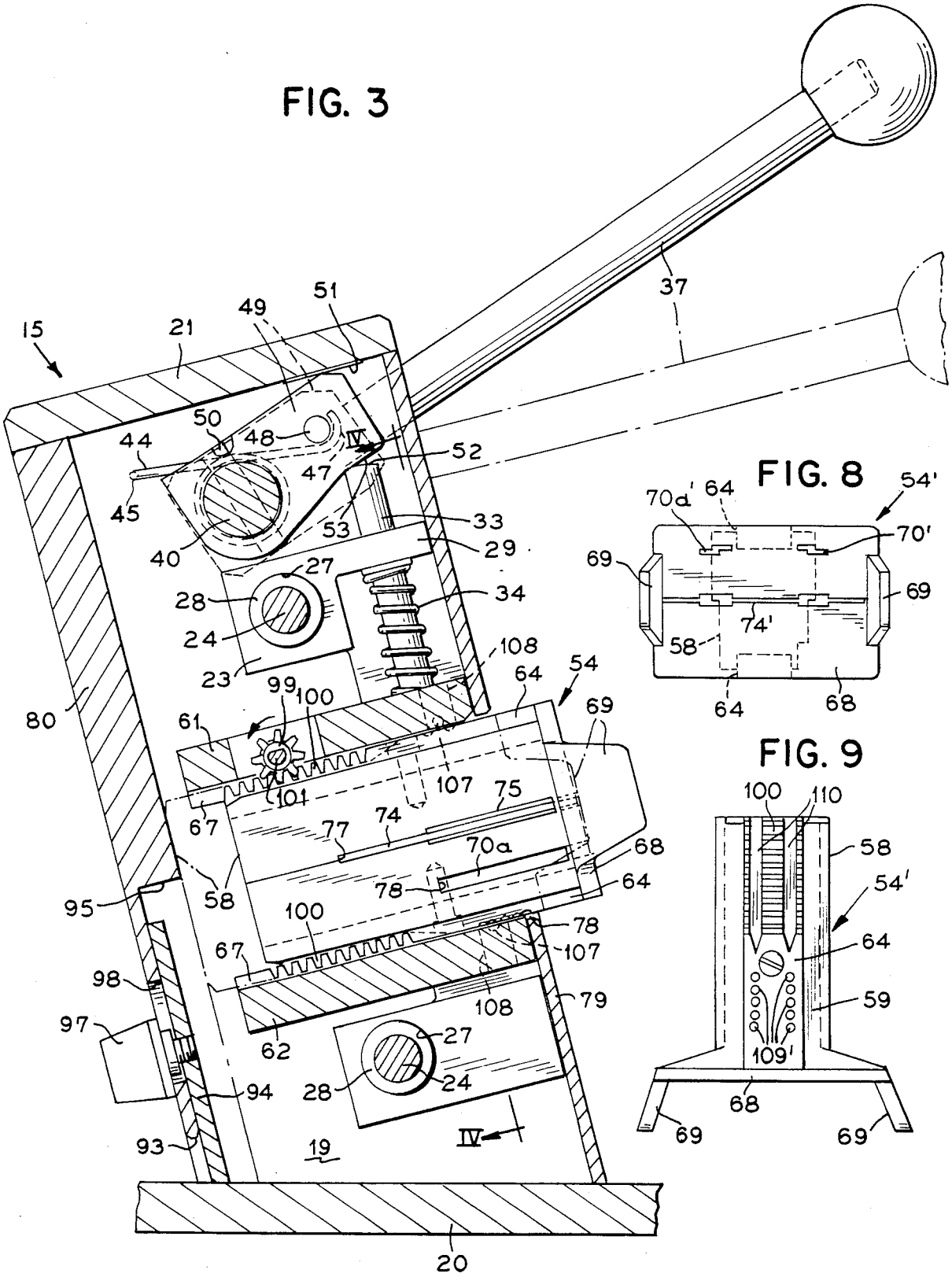
FIG. 3 is a vertical sectional detail view taken substantially along the line III—III in FIG. 2.
FIG. 8 is an enlarged front elevational view of the key carrying cassette shown in FIG. 7.
FIG. 9 is a top plan view of the cassette of FIG. 8.

Introduction of the cassette into the duplicator unit 15 is through an entrance opening 78 in a front plate 79 which is removably secured across the front of the frame 17. Stop means limiting inward movement of the cassette 54 is desirably provided by a combination stop and rear closure plate 80 secured to and between the rear edges of the side frame plate 18 and 19. FIG. 3 shows an dash outline the inwardly stopped position of the cassette 54. The cassette is now in the ready position to commence notching the serration edge of the key blank 55.

Figures 2, 5:
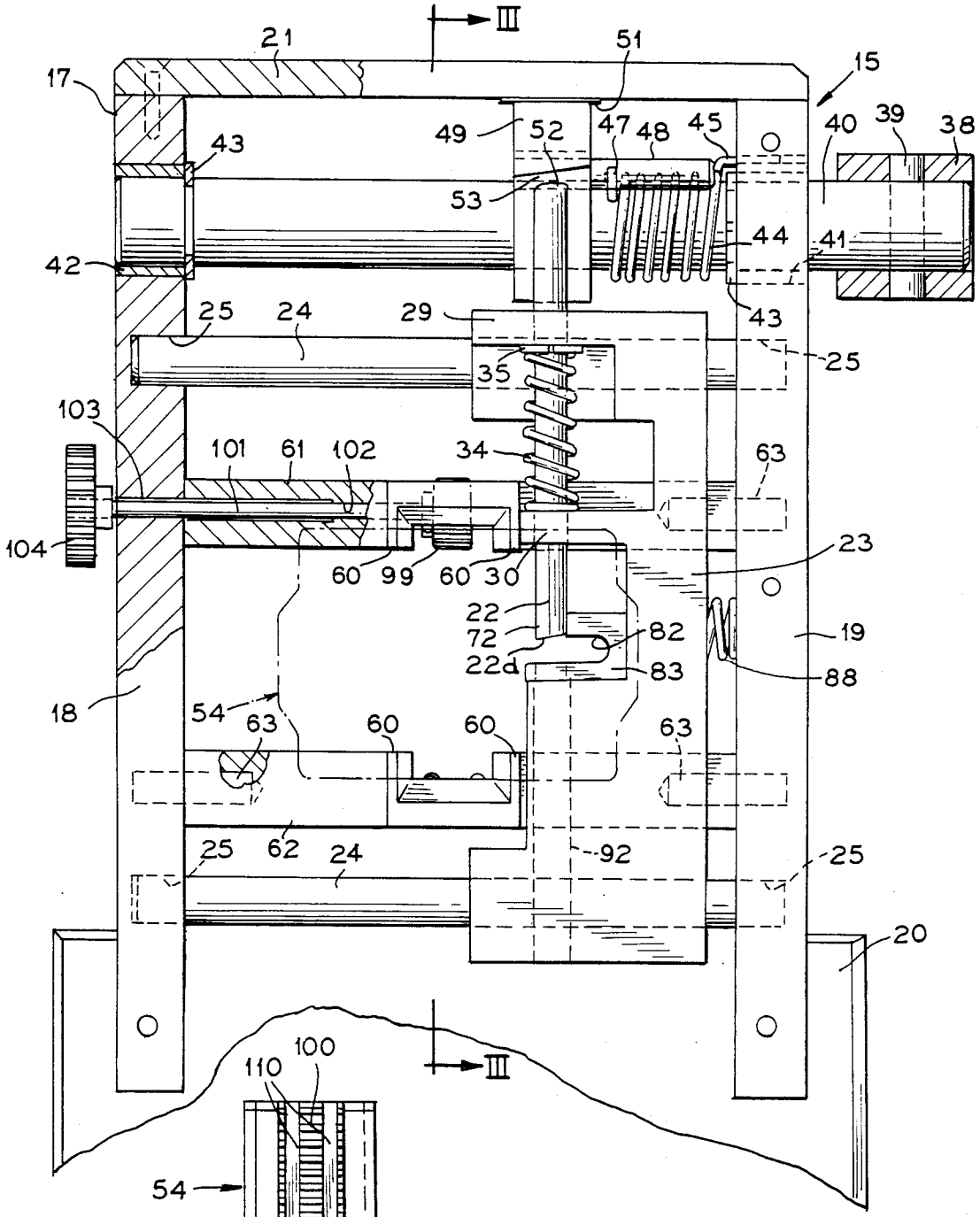
FIG. 2 is an enlarged front elevational view partially in section, of the duplicator of FIG. 1.
FIG. 5 is a top plan view of the key carrying cassette shown in FIG. 1.

As best seen in FIGS. 2 and 4, in its retracted position, the punch 22 has its notch cutting or punching tip 22*a* spaced sufficiently above an anvil 81 to permit free reception under the punch of the serration edge portion of the key blank 55 resting on the anvil and with the adjacent side projection of the carrying card 73 received within a clearance groove 82 in a combination anvil and punch backup block 83 carried within a complementary recess 84 in the inner side of the punch carrying member 23. The block 83 may be removably secured in place as by means of screws 85. The punch 22 slidably engages a lateral thrust relieving backup shoulder 87 on the member 83 (FIGS. 2, 4 and 6).

At the beginning of a serration notch punching operation, and with the cassette 54 pushed all the way into the punching machine, stopped against the back wall 80, the vertical notch depth controlling edge 72 of the punch 22 will be engaged in the serration edge notch nearest the head end of the key templet 57. Biasing means such as a compression spring 88 bearing at one end against the side frame plate 19 and at its opposite end against the floating punch carriage 23 within a socket 89, assures that the notching edge 73 is firmly presses into the notch which is to be duplicated in the key blank 55. Upon operating the handle 37 to depress the punch 22, a notch corresponding to the templet notch will be punched in the serration edge of the blank 55. For clearing the punch 22, the card 73 has a clearance opening 90 throughout the length of the serration edge of the blank 55. Upon punching the notch in the key blank, the material punched out then through a scrap clearance hole 91 in the anvil 81 and drops down through a scrap discharge bore 92 opening from the bottom end of the carriage 23, to collect in the space above the base 20 within the bottom of the machine.

Accumulated scrap from within the bottom of the machine may be from time-to-time dumped through a cleanout doorway opening 93 (FIG. 3) in the lower edge of the back wall panel 80. A cleanout door 94 is vertically reciprocably accommodated within a recess 95 in the inner face of the rear wall panel 80 and is adapted to be manipulated into and out of closing relation to the doorway 93 as by means of a handle knob 97 attached to the door and extending through a vertically elongated clearance slot 98 for access at the rear of the rear wall panel. The upper edge of the recess 95 is below the cassette stop area of the back wall 80.

Means are provided for notch-by-notch advancing of the cassette 54 and accurate indexing of the cassette in each successive notching position. The advancing means desirably comprises a pinion 99 (FIGS. 2 and 3) meshing with a rack 100 provided in the upper surface of the tracking bar 67 (FIGS. 3 and 5). The pinion 99 is keyed to a drive shaft 101 extending through a bearing bore 102 in the upper support member 61 and projecting through a coaxial clearance bore 103 in the side wall frame panel 18. A digitally operable knob 84 is keyed to the outer end of the shaft 101 for turning the shaft as necessary. By having the pinion 99 and the shaft 101 free wheeling, the cassette 54 can be easily inserted into position within the machine without operating the knob 104.

During insertion of the cassette 54 into the notching position, the templet key can be readily pushed past the punch 22 which has convergent cam surfaces 105 extending longitudinally along the notch control edge 72 and which will cam along the edges of the notches in the serration edge 71 of the templet by pushing inwardly on the templet key 57 and causing the carriage 23 to yield laterally against the bias of the spring 88. Thereafter, during the punching operation as the cassette 54 is advanced outwardly step-by-step, that is notch-by-notch, the templet key 57 thrusts firmly against the stop 78 which holds the templet in its longitudinal position as the templet key is shifted with the cassette 54 to advance the assembly notch-by-notch past the punch 22.

Positive indexing of the cassette 54 with respect to the punch 22 in each punching operation is attained by means of spring biased ball detents 107 carried in detent holders 108 threadedly secured in the supporting members 61 and 62. Each of the tracking bars 64 has on its rack carrying face a set of indexing detent sockets 109 corresponding in number to the number of notches to be formed in the serration edge of the key blank 55 or 55*a*, as the case may be. In certain automotive keys there are five coded notches in the serration edges. Accordingly, there are shown, in FIG. 5, five of the detent sockets 109. The notches 109 are so related to one another that as the cassette 54 is advanced by notch increments, the detents 107 will successively engage one notch at a time. Besides accurately indexing the cassette 54, the detents 107 serve as sensible click mechanism which may be heard and will at least be sensed by sense of touch through the manipulating knob 104. Thus, a sensible click will be expreienced at each notching advance. It may be noted that to clear the detents 107 freely pass the rack 100 during insertion and removal of the cassette 54 with respect to the duplicator 15, longitudinal clearance grooves 110 are provided in the rack, and run out at the inner free end of the rack.

Both of the key blanks 55 and 55*a* carried by the card 73 may be notched at the same side of the cassette 54 simply by pulling the card 73 and reversing it when the key blank 55*a* is to be notched after the blank 55 has been notched. At such time of course the templet key 57 would be replaced by a templet key having a serration edge corresponding to the edge desired on the blank 55*a*. However, for convenience, the cassette body 58 may be provided with a templet key socket 70*a* on the opposite side from the socket 70 and properly oriented below the card socket slot 74 as viewed in FIG. 4. Through this arrangement, by removing the cassette 54 from the machine and turning it over and reinserting the same with the proper templet key in the slot socket 70*a*, the blank 55*a* may be punched by a repetition of the notching cycle already described. If desired, of course, the front face of the cassette 54 may be provided with suitable legends identifying which key is to be notched at which side of the cassette. For example, if an ignition key and a door lock key are to be notched, one of the sockets 70, 70*a* may be identified with respect to one of the keys and the other of the sockets may be identified with respect to the other key.

Each of the key carrying cards 73 may be formed from a castable or injection moldable plastic material, with the card body of a substantially thinner section than the section of the key blanks 55 and 55*a* which are of thicker section to provide adequate resistance to torsional stresses in the normal lock operating function of the keys after they have been serration edge punched as desired. In a convenient arrangement for use in the notching duplicator 15, the head end of each of the key blanks is connected by an integral hinge extension 111

(FIG. 6) separated along each side from the card body by a slot 112 but integrally connected at one end to the head of the key blank and at the opposite end to the card. The key blank head in each instance may be otherwise separated from the card body. Along opposite edges of the shank of the key blank, it is desirably connected by a breakaway thin web 113 to the card body, except for the punch clearance opening 90. Therefore, each key blank is firmly held in the plane of the card 73 until it is desired to use the key after it has been punched, whereupon the thin connecting webs 113 are broken and the key bent out of the plane of the card by means of the hinge 111. After use, the key may be easily returned to the plane of the card, and the key replaced in a storage place such as a wallet or purse or other convenient place.

Figure 7:
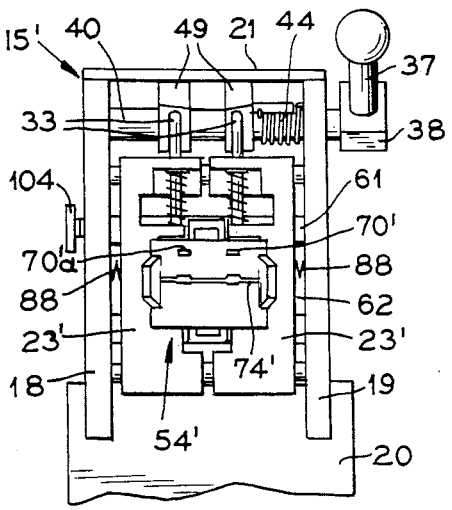
FIG. 7 is a front elevational view of a modification of the duplicator.

For some purposes it may be more convenient to have both key blanks punched simultaneously. This can be accomplished with only minor modification of the duplicator 15 of FIG. 1 to provide, as shown, in FIG. 7 the device 15' with dual punches, both operated by the same handle 37 and the same crank shaft 40 biased by the same torsion spring 44, but carrying two of the cam driving cam blocks 49 for translating rotary motion of the shaft into rectilinear motion of a pair of punch shafts 33 and the associated punching mechanism carried by a respective inwardly biased floating carriage 23' for each of the punches. In this instance, the cassette 54' (FIGS. 8 and 9) has the slot sockets 70' and **70*a*,' in horizontal spaced alignment, while the key blank card slot socket 74' remains in the same orientation as in the cassette 54. Otherwise, the duplicator 15' is substantially the same as the duplicator 15 except that with each notching stroke, each of the key blanks carried by the card will be simultaneously notched along its serration edge in accordance with the notching code carried by the respective templet key. To facilitate the dual punching mode, the cassette 54' may have the detent sockets 109' oriented in straight alignment in two rows of equal number, such as five in each row, where five digit coding is practiced. Otherwise, the structural features of the cassette may be substantially the same as for the cassette 54**, as indicated by common reference characters.

Figure 10:
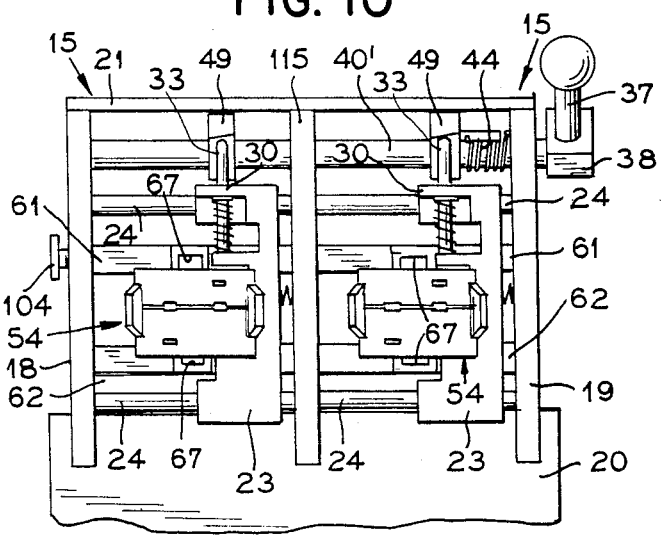
FIG. 10 is a front elevational view of another modification of the duplicator.

Another advantage of the device 15 or 15' is that without any major alterations except multiplication, a plurality of units can be mounted side-by-side as shown in FIG. 10 for simultaneous operation. In this arrangement two (although there may be more) identical notching unit assemblies are combined side-by-side with a partition frame panel 115 equally spaced from each of the side panels 18 and 19. In this instance, the mechanisms may all be the same as in either the FIG. 1 form or the FIG. 7 form but the operating crank shaft 40' will be elongated as shown so that all of the punches can be operated at the same time. The reference numerals in FIG. 10 aside from 115 and 40' correspond to the same reference numerals in FIGS. 1–6.

It will be understood that variations and modifications may be effected without departing from the spirit and scope of the novel concepts of the present invention.

We claim as our invention:

1. Apparatus for duplicative notching of the serration edge on a key blank according to the serration edge of an existing key serving as a templet, and comprising:

an axially movable key edge notching punch; a carriage for movably supporting said punch for axial movement and for movement in transverse direction relative to said axial movement;

means for floatingly supporting said carriage for enabling said transverse movement;

means for normally yieldably biasing the carriage in said transverse movement in one direction;

means for supporting the key blank and the templet in such relation to the punch that, under the control of said templet, the punch will upon axial movement in one direction relative to the carriage as positioned by said biasing means toward said supporting means form a notch in the serration edge of the key blank corresponding to a notch in the serration edge of the templet;

and means for effecting said axial movement of the punch.

2. Apparatus according to claim 1, wherein said means for supporting the key blank and the templet comprises a cassette having respective slot-like sockets therein spaced from one another in the axial direction of said punch for receiving the templet key and the key blank.

3. Apparatus according to claim 2, wherein the key blank socket is proportioned to receive a key blank carrying card.

4. Apparatus according to claim 3, wherein the key blank as a head, an integral hinge connecting said key blank head to said card, breakaway means normally retaining said key blank in the plane of said card, said card extending laterally beyond said serration edge of the key blank, and an opening in the card along said serration edge for clearing of said punch through the opening when forming a notch in said key blank serration edge.

5. Apparatus according to claim 3, wherein said card carries a plurality of key blanks, and said key blank socket is proportioned to receive each of said key blanks and a corresponding templet key socket in an operative relation to each of said key blank sockets.

6. Apparatus according to claim 5, having an axially movable key edge notching punch for simultaneously punching each of said key blanks, together with means for movably supporting each of said punches, and means for effecting said axial movement of each of the punches.

7. Apparatus according to claim 1, wherein the means for supporting the key blank and the templet comprises a cassette, means for guiding and advancing the cassette rectilinearly by notch increments relative to said punch, said punch having a longitudinal notch depth control edge which is biased into the serration edge notches of the templet selectively, and means for indexing the cassette by said notch increments relative to the punch.

8. Apparatus according to claim 7, wherein said indexing means comprises a sensible position indicating device.

9. Apparatus according to claim 1, wherein said means for supporting the key blank and the templet comprises a cassette, and means for guiding the cassette in punching relation to said punch.

10. Apparatus according to claim 9, wherein said means for guiding the cassette comprises track structure for unilinearly guiding the cassette relative to the punch, and said means for supporting said punch comprises a carriage structure movable laterally relative to said cassette, and means for biasing the carriage structure toward the cassette.

11. Apparatus according to claim 1, wherein said means for floatingly supporting said carriage comprises stationary guide bars and bearings supporting the carriage on the guide bars.

12. Apparatus according to claim 1, wherein said means for effecting movement of the punch comprises a crank shaft, a handle for operating said crank shaft, and means for translating rotary motion of the crank shaft into recitlinear motion of the punch.

13. A plurality of apparatus units each having all of the elements defined in claim 1, said unit being disposed side-by-side, and said means for effecting said axial movement of the punch being common to all of the units.

14. Apparatus for duplicative notching of the serration edge on a key blank according to the serration edge of an existing key serving as a templet, and comprising:

an axially movable key edge notching punch;

means for movably supporting said punch;

means for supporting the key blank and the templet in such relation to the punch that, under the control of said templet, the punch will upon axial movement in one direction form a notch in the serration edge of the key blank corresponding to a notch in the serration edge of the templet;

means for effecting said axial movement of the punch;

said means for supporting the key blank and the templet comprising a cassette having respective slot-like sockets therein for receiving the templet key and the key blank; and said key blank socket being proportioned to receive a key blank carrying card 15. Apparatus according to claim 14, wherein said card carries a plurality of key blanks, and said key blank socket is proportioned to receive each of said key blanks and a corresponding templet key socket in an operative relation to each of said key blank sockets.

16. Apparatus according to claim 15, having an axially movable key edge notching punch for simultaneously punching each of said key blanks, together with means for movably supporting each of said punches, and means for effecting said axial movement of the punches.

17. Apparatus according to claim 14, wherein the key blank has a head, an integral hinge connecting said key blank head to said card, breakaway means normally retaining said key blank in the plane of said card, said card extending laterally beyond said serration edge of the key blank, and an opening in the card along said serration edge for clearing of said punch through the opening when forming a notch in said key blank serration edge.

18. A method of duplicative notching of the serration of edge on a key blank according to the serration edge of an existing key serving as a templet, comprising:

supporting the key blank as carried in a card in a socket slot in a cassette and supporting the templet in a socket slot in said cassette cooperatively related to said key blank card slot, adjacent to an axially movable key edge notching punch;

controlling the punch by means of the templet for forming a predetermined notch in the serration edge of said key blank corresponding to a notch in said templet serration edge;

and while so controlling the punch moving said punch in one direction and forming said predetermined notch.

19. Apparatus for duplicative notching of the serration edge on a key blank according to the serration edge of an existing key serving as a templet, and comprising:

an axially movable key edge notching punch;

means for movably supporting said punch;

means for supporting the key blank and the templet in such relation to the punch that, under the control of said templet, the punch will upon axial movement in one direction form a notch in the serration edge of the key blank corresponding to a notch in the serration edge of the templet;

means for effecting said axial movement of the punch;

said means for supporting the key blank and the templet comprising a cassette;

means for guiding the cassette in punching relation to said punch;

said means for guiding the cassette comprising track structure for unlinearly guiding the cassette relative to the punch;

said means for supporting said punch comprising a carraige structure movable laterally relative to said cassette; and means for biasing the carriage structure toward the cassette.

20. Apparatus for duplicative notching of the serration edge on a key blank according to the serration edge of an existing key serving as a templet, and comprising:

a frame;

a base supporting said frame;

an axially movable key edge notching punch;

means for movably supporting said punch;

means for supporting the key blank and the templet in such relation to the punch that, under the control of said templet, the punch will upon axial movement in one direction form a notch in the serration edge of the key blank corresponding to a notch in the serration edge of the templet;

means for effecting said axial movement of the punch;

said punch comprising an elongated punch rod carrying said punch at its lower end;

a carriage supporting said punch rod for vertical reciprocation;

means normally biasing the punch rod and punch upwardly from a punching anvil;

a crankshaft carried by said frame and having a handle and a motion transmission for actuating the punch rod downwardly in said one direction in opposition to said biasing means for operation of the crankshaft by means of the handle;

said means for supporting the key blank and the templet comprising a cassette;

supporting means carried by the frame for guiding movement of the cassette from a front entrance into key notching position within the frame;

the templet carried by the cassette having its serration edge in engagement with the side of the punch above a notching end of the punch;

said cassette supporting the key blank on said anvil;

means normally biasing said carriage toward the templet;

means for advancing the cassette by serration edge notch increments relative to the punch; and means for indexing the cassette relative to each serration notch of the templet so that the punch will accurately punch a duplicate notch in the key blank with each operation of the crankshaft.

* * * * *